US005540484A

United States Patent [19]

Grundei et al.

[11] Patent Number: 5,540,484

[45] Date of Patent: Jul. 30, 1996

[54] SURGEON'S CHAIR SEAT

[75] Inventors: Hans Grundei, Lübeck; Horst Laqua, Gross-Grönau, both of Germany

[73] Assignee: Schütt & Grundei Orthopädietechnick GmbH, Lübeck, Germany

[21] Appl. No.: 284,858

[22] Filed: Aug. 2, 1994

[30] Foreign Application Priority Data

Aug. 3, 1993 [DE] Germany ..... 43 26 022.5

[51] Int. Cl.[6] ..... A47C 7/02

[52] U.S. Cl. ..... 297/452.23; 297/195.11

[58] Field of Search ..... 297/DIG. 3, 200, 297/199, 452.21, 452.41, 284.6, 452.29, 440.22, 452.23, 195.1, 195.11

[56] References Cited

U.S. PATENT DOCUMENTS

| | | | |
|---|---|---|---|
| 4,746,168 | 5/1988 | Bracesco | 297/284.6 X |
| 4,953,913 | 9/1990 | Graebe | 297/459 |
| 4,965,898 | 10/1990 | So | 5/468 |
| 5,052,068 | 10/1991 | Graebe | 297/DIG. 3 X |
| 5,333,930 | 8/1994 | Glenn | 297/195.1 X |
| 5,356,205 | 10/1994 | Calvert et al. | 297/452.41 |

FOREIGN PATENT DOCUMENTS

| | | |
|---|---|---|
| 2132741 | 1/1973 | Germany . |
| 3724233 | 9/1988 | Germany . |

*Primary Examiner*—Milton Nelson, Jr.
*Attorney, Agent, or Firm*—Panitch Schwarze Jacobs & Nadel, P.C.

[57] ABSTRACT

A seat for a chair for surgeons is provided with the seating surface formed from a large number of resilient or partially resilient support elements (1 through 8). These are seated in through-holes (9) in a carrier piece (10). The support elements (1 through 8) have different heights, spread out appropriately over the seating surface, and are arranged for anatomically correct support.

7 Claims, 2 Drawing Sheets

Fig. 2
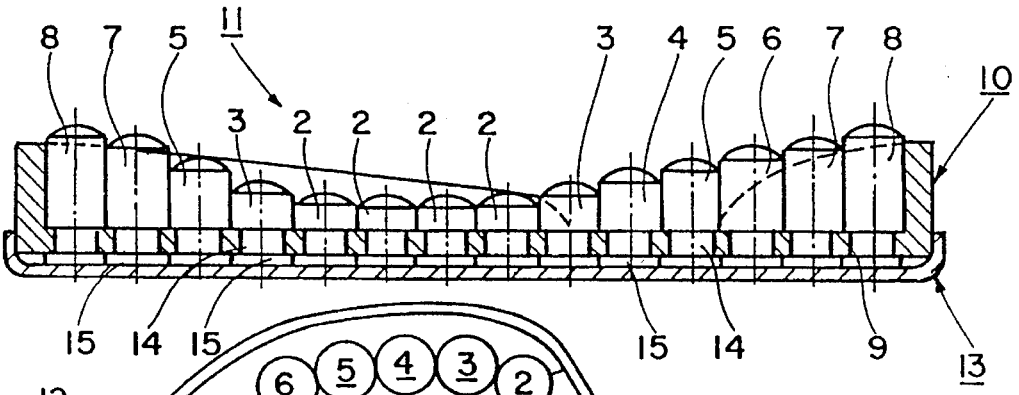
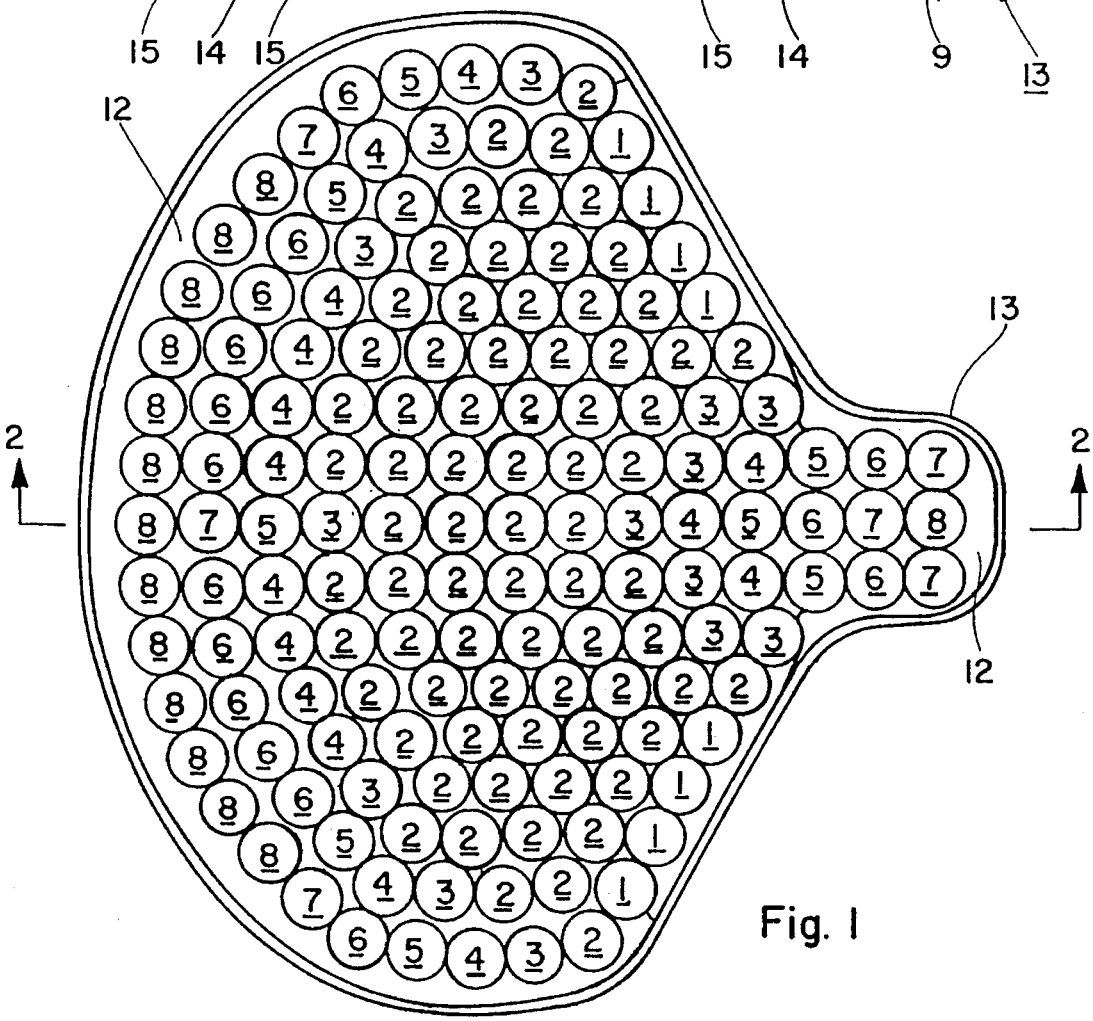
Fig. 1

Fig. 3
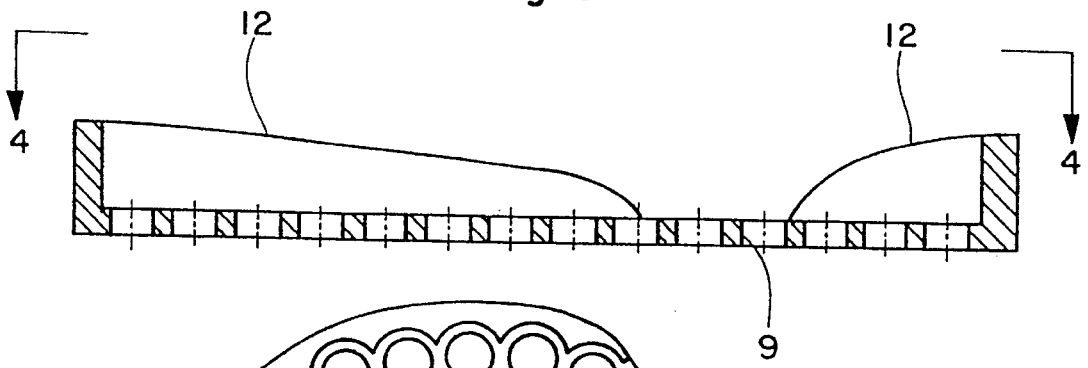
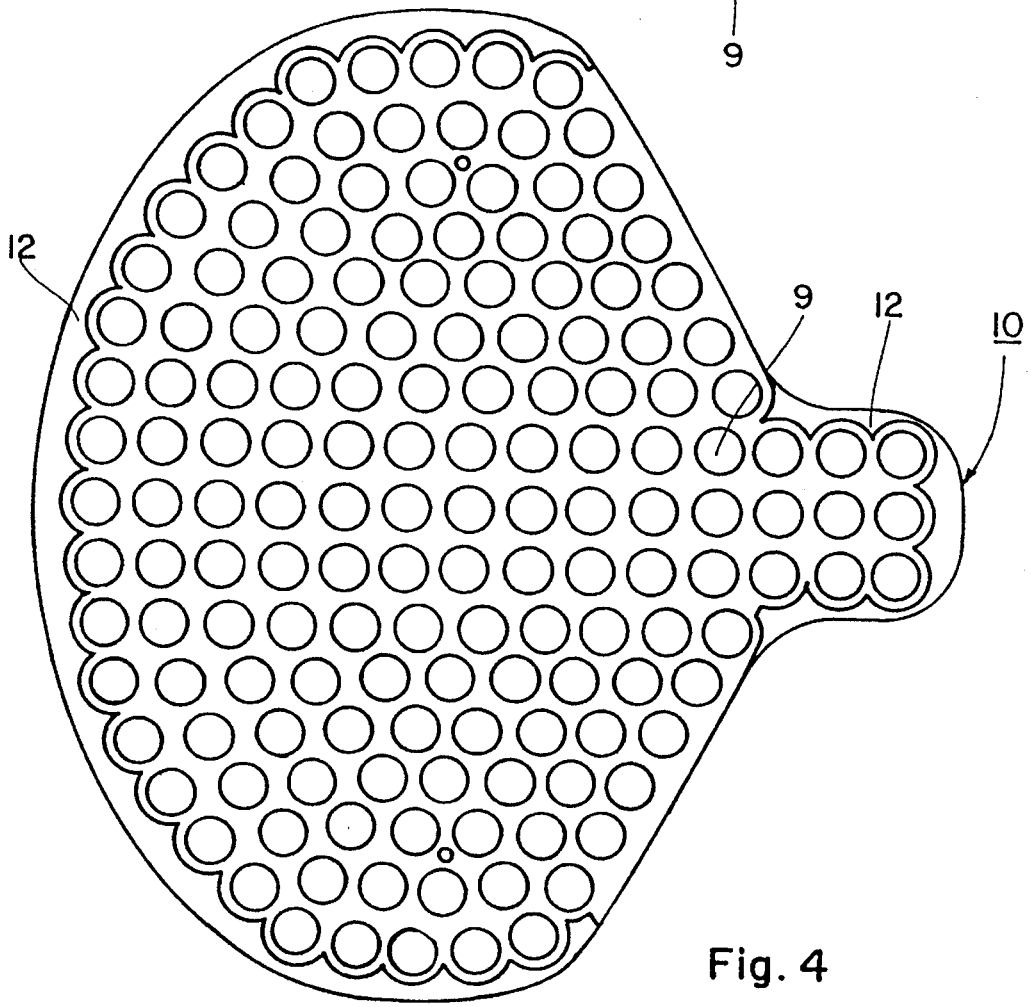
Fig. 4

SURGEON'S CHAIR SEAT

FIELD OF THE INVENTION

The present invention relates to a seat for a chair for surgeons, of the type used, in surgery, and in particular in micro-surgery.

BACKGROUND OF THE INVENTION

Micro-surgical operations in particular often require several hours of time, during which, however, the surgeon must work with intense concentration. Even in medical practices such as the ones of ear, nose and throat specialists or eye specialists, there are situations in which the doctor must remain in a seated position for a long period of time during the treatment. Every kind of inconvenience of a physical nature should be eliminated under such conditions, since they can significantly reduce concentration. Such a physical inconvenience may be seen in the fact that the surgeon has to sit for hours at a time on a chair for surgeons that might be covered only with an upholstered cushion. Individual expressions of dissatisfaction on the part of the medical profession are reason to take up this problem.

From DE-OS 21 32 741 a seat cushion is known that has a large number of resilient pins spaced from one another, several of which may be rounded off into a mushroom shape. When a person sits on this seat cushion, these pins bend to the side in one direction or another, depending on the local surface pressure on each of these pins. Depending on the hardness of the material of the seat cushion, and thus the pins, they are either partially or completely bent over. The person sitting on them will thus sit to a certain extent free-floating on the seating surface formed by the pins. This is not well-suited to alleviate the physical discomforts of a surgeon during hours-long operations.

From U.S. Pat. No. 4,953,913 a seat cushion is known, the interior of which is formed of pegs that are spaced from one another and that form the supporting surface, and that are presumably made of a foam material. It must be assumed that these pegs also carry out the deflection movement under weight that was described above. In any case, this seat cushion cannot perform a contour-related, weight relief function.

As has already been mentioned, the seat according to the invention is to find application in micro-surgery in particular. The seat cushions according to the state of the art are completely unsuited for this purpose, since the seat cushion on which the surgeon sits in a, so to speak, free-floating fashion, allows small movements that are inconsistent with the precision with which the micro-surgical procedures have to be carried out.

SUMMARY OF THE INVENTION

It is against this background that the invention must be seen, the purpose of which includes producing a chair seat for surgeons which is individually adjustable during assembly and offers a high degree of seating comfort. In that regard, it must be recognized that chairs of this type are, as a rule, used only by a few specific people.

The above objects are achieved according to the present invention in which a seat for a chair for surgeons is provided, wherein the seating surface is formed from a large number of support elements that are placed close to each other (i.e., essentially or substantially abut each other so as not to bend over under pressure). The support elements are made of a resilient or partially resilient material and are seated in through-holes supported in a carrier piece. The support elements have differing heights and are arranged on the seating surface spread out in such a way that the seating surface essentially follows the contours of the part of the body that is to be supported, that is the buttocks.

The construction according to the invention makes possible the optimum seating contour for the probable primary user of the seat, which optimum is determined by means of a color impression procedure, which is carried out in much the same way as a foot impression procedure in orthopedic technology. For this purpose, a plate is provided with India ink on its underside. The probable user of the seat sits down on top of the plate, which is pressed onto a sheet of paper lying underneath it. The surface pressure produces a specific color pattern; namely, wherever the pressure is the greatest, a more intensive coloring takes place than on surfaces where there is less pressure.

Exactly corresponding with this pattern, the seating contour of the seat according to the invention is manufactured by assembling onto the carrier piece the corresponding support elements. The shortest support elements are used at the points of greater pressure, and the longest support elements are used at the points of lowest pressure.

The seating comfort of the seating surface formed by the knob-like support elements is enormously high. If, at some point, one or more of the support elements should be damaged, they can be easily replaced. To do this, the base plate is removed from the carrier piece, and the damaged support element is simply pressed out upwards through the through-hole, and is replaced by a new support element.

Preferably, the support elements are seated by means of a cylindrical constriction for support in the through-holes and lie against the underside of the carrier piece with a part that is essentially disk-shaped. For assembly or replacement of a support element, the element is brought from above to a through-hole in the carrier piece, its disk-shaped part elastically deformed in such a way that it can be pressed through the through-hole. Finally, the support element can be pressed into the through-hole in such a way that its cylindrical constriction comes to rest in the through-hole. For this purpose, the cylindrical constriction has a length that essentially corresponds to the thickness of the carrier piece. To press out a support element in case of repairs, it can then be pressed out of the through-hole upwards, again by deforming the disk-shaped part.

In accordance with a preferred embodiment of the invention, the support elements have a cylindrical shape that is rounded off on the top. The seating comfort is increased even further in this way. In accordance with an advantageous further development, the carrier piece has an edge that at least partially surrounds the seating surface. This serves to prevent the support elements from bending away to the side.

BRIEF DESCRIPTION OF THE DRAWINGS

The foregoing summary, as well as the following detailed description of a preferred embodiment of the invention, will be better understood when read in conjunction with the appended drawings which show further features and advantages of the invention. For the purpose of illustrating the invention, there is shown in the drawings an embodiment which is presently preferred. It should be understood, however, that the invention is not limited to the precise arrangements and instrumentalities shown. In the drawings:

FIG. 1 is a top view of the seat according to the invention with support elements assembled on it;

FIG. 2 is a sectional side view of the seat according to FIG. 1 taken along line 2—2 in FIG. 1;

FIG. 3 is a sectional side view similar to FIG. 2 of the carrier piece of the seat according to FIGS. 1 and 2; and FIG. 4 is a top view of the carrier piece of FIG. 3, taken along line 4—4 in FIG. 3.

DETAILED DESCRIPTION OF PREFERRED EMBODIMENT

FIG. 1 shows, in top view, an embodiment of the seat according to the invention. The numerous support elements 1 through 8 that are placed closely next to one another can be seen. These are made of resilient or partially resilient material. They rest in through-holes 9 in a carrier piece 10 (FIGS. 2–4). In the present embodiment shown, the support elements 1 through 8 are arranged over the seating surface 11 in such a way that they follow the contours of the buttocks, as can be seen clearly in FIG. 2.

FIG. 2 shows a sectional view along the symmetrical axis of the seat according to FIG. 1. As already mentioned, the support elements 1 through 8 rest in through-holes 9 in the carrier piece 10. The seat is closed off on the bottom by means of a base plate 13. The base plate 13 can, however, be easily disassembled from the carrier piece 10, for example, by loosening a screw connection (not shown). The support elements 1 through 8 are primarily of a cylindrical shape, and include an approximately cylindrical constriction 14. The cylindrical constriction 14 is seated in the through holes 9, that is, it has a length that approximately corresponds to the thickness of the carrier piece 10. At the bottom, the support elements 1 through 8 have essentially disk-shaped parts 15 that lie against the carrier piece 10 from the bottom. The support elements 1 through 8 are, in addition, rounded off on their seating surface ends in order to further increase the seating comfort.

In FIGS. 1 and 2, the edge 12 that at least partially surrounds the seating surface 11 can be seen, but it is shown more clearly in FIG. 3. FIG. 3 shows a sectional view through the carrier piece 10. Clearly visible here is the edge 12, which in the present case does not completely surround the seating surface 11, but rather only at those locations at which the support elements 1 through 8, when placed under a weight, could bend over if there were no edge.

The carrier piece 10 is, as shown in FIG. 4, is configured in one piece from a workpiece, for example from a piece of cast metal. In addition, it can be seen that the edge 12 is configured in such a way that it partially surrounds each of the immediately adjacent support elements for the purpose of stabilizing them.

Each seat can be manufactured to correspond to the anatomical characteristics of the probable primary user of the seat. To do this, the color impression procedure that was already mentioned is used. The result of this procedure is transferred to the seat by equipping the carrier piece with the support elements (1–8) that correspond with it. At locations where a high surface pressure was determined, small (low) support elements are placed into the through-holes, while at locations with a low surface pressure, correspondingly high (long) support elements are placed into the through-holes.

Even if a seat is not to be manufactured exclusively for one user, for example for a medical practitioner, but rather for several regular users, for an operating room in a clinic for example, with the seat according to the invention there is an enormous increase in seating comfort for the surgeon in comparison to conventional seats. The reason for this can be seen in the nearly constant dimensional relationships from pelvis to pelvis, even if the connective tissue, muscles, etc. elicit a completely different appearance. What is of critical importance for seating comfort, however, is primarily the osseous skeleton.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A seat for a chair for surgeons comprising a seating surface (11) formed from a plurality of at least partially resilient support elements (1–8) arranged close together, the support elements being supported in through-holes (9) in a carrier piece (10), wherein the support elements (1–8) have differing heights and are spread out on the seating surface (11) in such a way that the seating surface is adapted to essentially follow contours of a body part to be supported, the support elements (1–8) each having a portion which extends above the through-holes in the carrier piece (10) and wherein the carrier piece (10) has an edge (12) that at least partially surrounds, supports and directly contacts the portions of at least some of the support elements (1–8) which extend above the through-holes in the carrier piece (10) adjacent to the edge (12) contributing to the stabilization of the seating surface.

2. The seat according to claim 1, wherein the carrier piece (10) is closed off on its underside by means of a removable base plate (13).

3. The seat according to claim 1, wherein the support elements (1–8) have a cylindrical shape, an approximately cylindrical constriction (14) for support in the through-holes (9), and an essentially disk-shaped part (15) that is of a larger diameter than the through-holes (9) to lie against the underside of the carrier piece (10).

4. The seat according to claim 3, wherein the support elements (1–8) each have a free end, and the support elements (1–8) are rounded off on their free ends.

5. The seat according to claim 3, wherein the carrier piece (10) is closed off on its underside by means of a removable base plate (13).

6. The seat according to claim 1, wherein the support elements (1–8) each have a free end, and the support elements (1–8) are rounded off on their free ends.

7. The seat according to claim 6, wherein the carrier piece (10) is closed off on its underside by means of a removable base plate (13).

* * * * *